US011156357B2

(12) United States Patent
Rousseau

(10) Patent No.: US 11,156,357 B2
(45) Date of Patent: Oct. 26, 2021

(54) INSTALLATION FOR AUTOMATED STRAIGHTENING OF A CANDLE WICK AND ASSOCIATED AUTOMATED STRAIGHTENING METHOD

(71) Applicant: MANUFACTURE FRANCAISE DE BOUGIES, Carnoux-en-Provence (FR)

(72) Inventor: Guilhem Rousseau, Roquevaire (FR)

(73) Assignee: Manufacture Francaise De Bougies, Carnoux-en-Provence (FR)

( * ) Notice: Subject to any disclaimer, the term of this patent is extended or adjusted under 35 U.S.C. 154(b) by 71 days.

(21) Appl. No.: 16/048,699

(22) Filed: Jul. 30, 2018

(65) Prior Publication Data

US 2018/0335207 A1 Nov. 22, 2018

Related U.S. Application Data

(63) Continuation of application No. PCT/FR2017/050189, filed on Jan. 27, 2017.

(30) Foreign Application Priority Data

Jan. 28, 2016 (FR) ..... 16/50683

(51) Int. Cl.
*F23D 3/28* (2006.01)
*C11C 5/00* (2006.01)

(52) U.S. Cl.
CPC ..... *F23D 3/28* (2013.01); *C11C 5/006* (2013.01)

(58) Field of Classification Search
CPC ..... C11C 5/006; F23D 3/28
See application file for complete search history.

(56) References Cited

U.S. PATENT DOCUMENTS 3,799,492 A 3/1974 O'Laughlin
3,958,909 A * 5/1976 Estrugo ..... C11C 5/026 425/112

(Continued)

FOREIGN PATENT DOCUMENTS

DE 2328267 1/1974
DE 3620607 4/1987

(Continued)

OTHER PUBLICATIONS

International Search Report for International Application PCT/FR2017/050189, dated Apr. 19, 2017.

*Primary Examiner* — Jorge A Pereiro
*Assistant Examiner* — Logan P Jones
(74) *Attorney, Agent, or Firm* — Burris Law, PLLC

(57) ABSTRACT

An apparatus for automatically straightening a candle wick inside a receptacle containing a fusible combustible material in the solidification phase is provided that includes a detection system operable to detect an initial position of the wick inside the receptacle, a movable gripping system operable to grasp and displace the wick, and a control system connected to the detection system to drive it in a detecting manner and receive the initial position. The control system is connected to the gripping system to drive it in a gripping and displacing manner, from a rest configuration to an initial configuration in which the gripping system grasps the wick in its initial position and then to a final configuration in which the gripping system has vertically straightened the wick.

10 Claims, 5 Drawing Sheets

(56) References Cited

U.S. PATENT DOCUMENTS

| | | | | |
|---|---|---|---|---|
| 4,830,565 | A | 5/1989 | Bucher et al. | |
| 6,090,331 | A | 7/2000 | Schwarz et al. | |
| 7,736,145 | B1 | 6/2010 | Horvath et al. | |
| 2009/0092938 | A1 | 4/2009 | Husted et al. | |
| 2011/0310525 | A1* | 12/2011 | Lu | H01L 21/6833 361/234 |
| 2012/0137634 | A1* | 6/2012 | Cagle | C11C 5/008 53/431 |
| 2013/0030570 | A1* | 1/2013 | Shimizu | B25J 9/1679 700/259 |

FOREIGN PATENT DOCUMENTS

| | | | | |
|---|---|---|---|---|
| DE | 10113843 | | 11/2002 | |
| DE | 102010000283 | A1 * | 7/2011 | C11C 5/023 |
| EP | 0076135 | | 4/1983 | |

* cited by examiner

INSTALLATION FOR AUTOMATED STRAIGHTENING OF A CANDLE WICK AND ASSOCIATED AUTOMATED STRAIGHTENING METHOD

CROSS-REFERENCE TO RELATED APPLICATIONS

This application is a continuation of International Application No. PCT/FR2017/050189, filed on Jan. 27, 2017, which claims priority to and the benefit of FR 16/50683 filed on Jan. 28, 2016. The disclosures of the above applications are incorporated herein by reference.

FIELD

The present disclosure relates to an installation for automatically straightening a candle wick inside a receptacle containing a fusible combustible material in the solidification phase, as well as to the automated straightening method associated thereto.

BACKGROUND

The statements in this section merely provide background information related to the present disclosure and may not constitute prior art.

The present disclosure is in the field of candle manufacturing lines shaped to fill receptacles with fusible combustible material and place wicks inside the receptacles, each candle thus comprising a receptacle containing a fusible combustible material and a wick.

In a conventional manner, the fusible combustible material, generally of the natural wax or paraffin wax type, is introduced into the receptacle in liquid form, with the presence of the wick generally supported at its low end by a support placed in the bottom of the receptacle, then the fusible combustible material cures until it is completely rigid or solid, thereby immobilizing the wick caught in the solid fusible combustible material.

Referring to FIG. 1 which illustrates a candle 1 comprising a receptacle 10 containing a fusible combustible material 11 and a wick 12 carried by a support 13 placed in the bottom 14 of the receptacle 10, a collapse of the wick 12 is conventionally observed, in particular under gravity as the fusible combustible material 11 solidifies.

Such a collapse consists in a bending of the wick 12 which no longer extends along a vertical central axis 15 of the receptacle 10, leading to a decentering of its high part, so that this high part of the wick 12 (which protrudes in part from the level of the fusible combustible material 11) gets closer to the walls of the receptacle 10. If the wick 12 is immobilized in such a collapsed position, it is common practice for the manufacturer to remove the candle 1 which becomes unmarketable for aesthetic reasons but especially for reasons of decrease in the burning time of the wick 12.

Referring to FIG. 2, which illustrates the same candle 1 as in FIG. 1, it is preferable that the wick 12 is erected vertically inside the receptacle 10, and more specifically at the center of the receptacle 10, so that the wick 12 extends along the vertical central axis 15 of the receptacle 10.

For the wick to be immobilized in such a vertical central position, at the end of the solidification of the fusible combustible material, several solutions are known.

A first solution, known from the document U.S. Pat. No. 7,736,145, consists in using a dip tube inside which the wick is positioned, the dip tube being supported by a carrying member bearing on the edges of the receptacle. However, such a solution is particularly complex because it is necessary to manually place each wick in the tube, not to mention that it uses a first pouring of fusible combustible material with the present dip tube until complete solidification, then a second pouring of fusible combustible material without the dip tube.

A second solution, known in particular from the documents U.S. Patent Publication No. 2009/0092938, U.S. Pat. No. 3,799,492, DE 36 20 607, and U.S. Pat. No. 6,090,331, consists in using an upper stopper bearing on the edges of the receptacle and traversed in its center by the high end of the wick, such an upper stopper being provided to limit or block the movement of the wick at its high end. However, on a candle manufacturing line, at a higher or lower rate, it is difficult to position, manually and one by one, each upper stopper on the receptacle while passing the wick through the center of the upper stopper, with a very limited benefit in terms of cost and efficiency.

A third solution, known from the document DE 23 28 267, consists of pneumatic means adapted to emit directed air flows to straighten the wick. However, such a pneumatic solution is not very accurate for replacing a wick at the center of its receptacle, and is unsuitable for vertically straightening a collapsed wick.

SUMMARY

The present disclosure provides an automated and effective way to obtain vertically erected wicks at the center of the receptacles, and which is adapted to a high-rate candle manufacturing line.

To this end, the present disclosure proposes an installation/apparatus for automatically straightening a candle wick inside a receptacle containing a fusible combustible material in the solidification phase, said installation comprising:

a detection system able to detect an initial position of the wick inside the receptacle;

a movable gripping system able to grasp and displace the wick relative to the receptacle; and a control system connected, on the one hand, to said detection system in order to drive it in a detecting manner and receive said initial position of the wick relative to the receptacle and, on the other hand, to said gripping system in order to drive it in a gripping and displacing, from a rest configuration to an initial configuration in which said gripping system grasps the wick in its initial position and then to a final configuration in which said gripping system has vertically straightened the wick inside the receptacle.

Thus, the present disclosure proposes, instead of an upper stopper or dip tube or air flow, to let the wick collapse naturally and to straighten it vertically by a gripping system driven by a control system, after having located or detected the initial collapsed position of the wick thanks to the detection system. If, in the initial position, the wick is not collapsed and is erected vertically, then the control system does not drive any straightening operation by the gripping system.

According to one characteristic, the installation comprises a system for holding the candle receptacle in a fixed position during detection by the detection system and during gripping and displacement of the gripping system.

In a first variant, the receptacle can be stationary during detection by the detection system, then the receptacle is displaced before being held stationary during gripping and displacement of the gripping system.

In a second variant, the receptacle moves continuously during the detection by the detection system and during gripping and displacement of the gripping system, so that the control system integrates this continuous displacement to accurately drive the detection system and the gripping system.

According to another characteristic, the gripping system comprises a clamp adapted to grasp the wick and attached to a manipulator movable along a vertical direction and along at least one horizontal direction.

Depending on the size of the clamp, relative to the dimensions of the candle, the manipulator can be movable along a single horizontal direction or be movable along two orthogonal horizontal directions.

In one particular form, the gripping system is equipped with a device for regulating a force exerted vertically on the wick, in order to allow a vertical pulling of the wick with a controlled force.

In another particular form, the detection system comprises at least one detector selected from the group consisting of a laser range-finder, an ultrasonic range-finder, a radar range-finder, and one or more infrared or visible camera(s).

In general, the detection system is a contactless system, so that the detection system does not come into contact with the wick which, by definition, is light and immersed in a fluid combustible material (not yet rigid or solid), so that the detection system does not displace the wick so as not to affect the driving of the gripping system for straightening the wick.

According to one variation of the present disclosure, the detection system comprises a range-finder movable relative to the receptacle of the candle in order to scan the entire candle for detecting the initial position of the wick.

According to another form of the present disclosure, the range-finder is movable horizontally.

The present disclosure also concerns a station for automatically straightening the candle wicks disposed in successive rows along a horizontal transverse direction and conveyed in translation along a horizontal longitudinal direction, where the station comprises a plurality of automated straightening installations according to the present disclosure.

In such a station, an installation can be used for straightening several neighboring candles in the row (by displacing the detection system and the gripping system from one candle to the other), and the control system can be common to the different installations.

The present disclosure also relates to a candle manufacturing line comprising at least one automated straightening station.

Advantageously, the manufacturing line comprises at least two automated straightening stations according to the present disclosure, these automated straightening stations being separated by a system conveying for the candles.

In this way, the straightening of the wicks can be done at several distinct times during the solidification phase of the fusible combustible material, for example at the beginning of the solidification and in the middle of the solidification; the conveying speed, the spacing between the stations and the solidification rate of the fusible combustible material being parameters to be taken into account for straightening the wicks at the right times so that, once the fusible combustible material is solidified, the wicks are erected vertically in the receptacles of the candles.

The present disclosure further concerns a method for automatically straightening a candle wick inside a receptacle containing a fusible combustible material in the solidification phase, said method comprising the following steps:

detecting an initial position of the wick inside the receptacle using a detection system; and grasping the wick in its initial position and displacing said wick until its vertical straightening inside the receptacle by using a movable gripping system.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
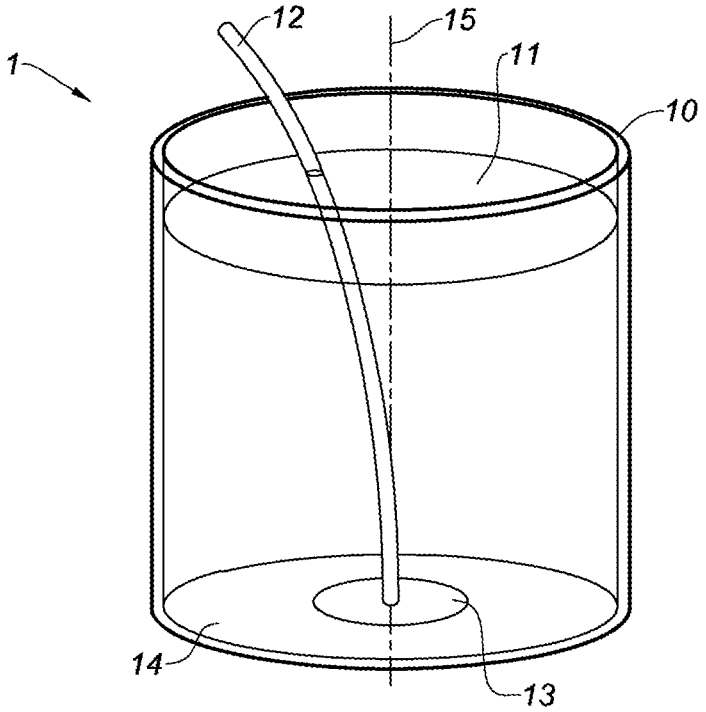
Fig. 1 PRIOR ART
FIG. 1 is a schematic perspective view of a candle whose wick is collapsed according to the prior art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 3:
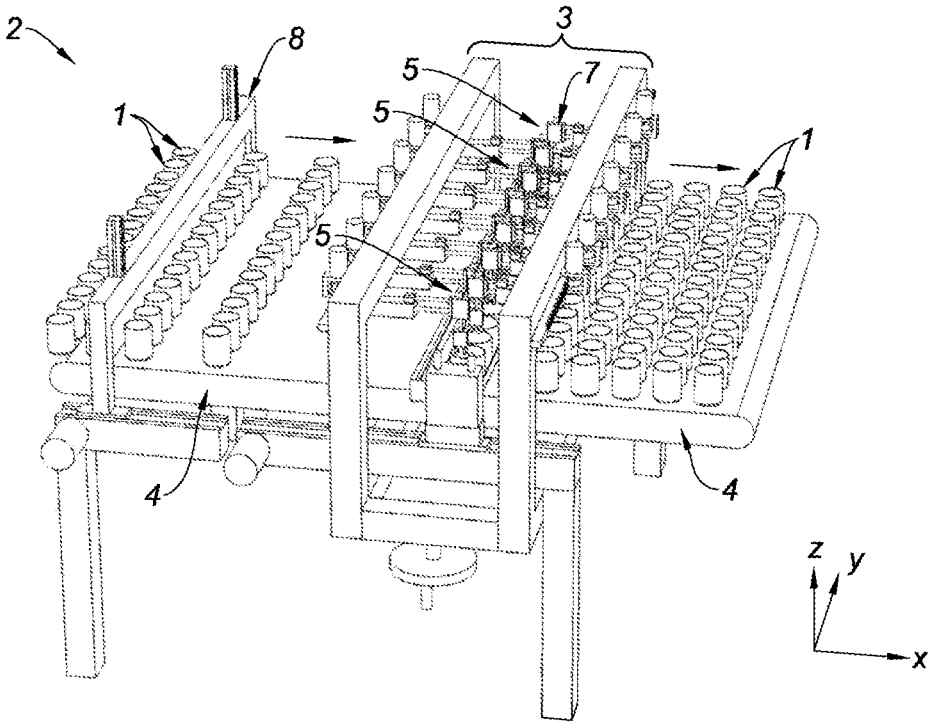
FIG. 3 is a schematic perspective view of a portion of a candle manufacturing line with an automated straightening station framed by two conveyors according to the present disclosure.

With reference to FIG. 3, a candle manufacturing line 2 comprises at least one straightening station 3 framed by one or two conveyor(s) 4, for example of the roller conveyor or conveyor belt type, which convey the candles 1 disposed in successive rows along a horizontal transverse direction Y, these rows of candles 1 being conveyed in translation along a horizontal longitudinal direction X orthogonal to the transverse direction Y.

An input conveyor 4 conveys the rows of candles 1 at the inlet of the straightening station 3, and an output conveyor 4 conveys the rows of candles 1 at the outlet of the straightening station 3, or a single conveyor performs this conveying task at the inlet and at the outlet of the straightening station 3.

Figure 2:
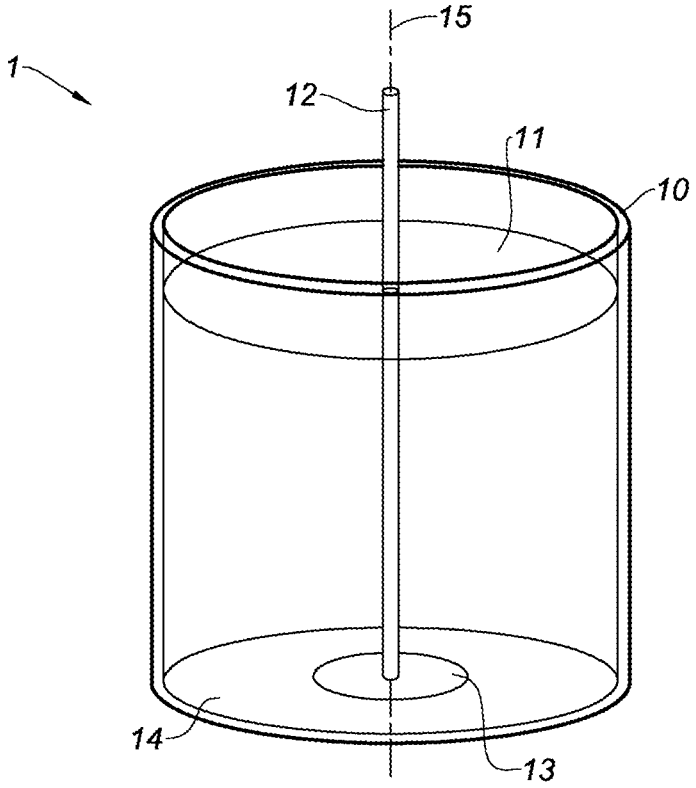
Fig. 2 PRIOR ART
FIG. 2 is a schematic perspective view of a candle whose wick is straightened vertically according to the prior art.

The candles 1 are as described previously with reference to FIGS. 1 and 2, in the sense that they each comprise a receptacle 10 containing a fusible combustible material 11 and a wick 12 carried by a support 13 placed in the bottom 14 of the receptacle 10. For each wick 1 at the inlet and at the outlet of the straightening station 3, the fusible combustible material 11 is in the solidification phase, in other words the fusible combustible material 11 is still fluid, with the risk of collapse of the wick 12 as described above with reference to FIG. 1.

The straightening station 3 is provided to automatically straighten the collapsed wicks of the incoming candles 1, row by row, in order to output candles 1 having their wicks straightened vertically. Collapse of the wick may occur on all or part of the candles 1 of the processed row in the straightening station 3, or on any of the candles 1 of the processed row.

The straightening station 3 may be preceded by a spacing unit 8 capable of isolating the rows at the inlet of the straightening station 3, such as for example a blade separator, in order to feed the straightening station 3 with rows of candles sufficiently spaced from each other with respect to the duration of operations related to the straightening of the wicks.

The straightening station 3 includes a system for aligning the processed row of candles 1, otherwise called row aligner, which forms a system for holding each candle receptacle 1 in a fixed position in alignment along the transverse direction Y, during all the operations related to the straightening of the wicks.

For the straightening of the wicks, the straightening station 3 comprises several automated straightening installations/apparatuses 5, and particularly a straightening installation/apparatus 5, every two candles 1 in the row, namely N straightening installations 5 for rows of 2N candles 1.

In a more expensive variant offering a shorter processing time, the straightening station 3 comprises as many straightening installations 5 as candles 1 in a row. In a less expensive variant offering a higher processing time, the straightening station 3 comprises a straightening installation 5 every three candles 1 in the row, or even every four candles or more.

With reference to FIGS. 4 to 10, a straightening installation 5 comprises at least one detection system 6 able to detect an initial position of the wick 12 inside the receptacle 10 of a candle 1. This initial position corresponds to the position of the wick 12 before the operations related to the straightening, and the initial position may correspond to an undesired collapsed position or to a desired vertically erected position. It should be noted that the number of detection systems 6 may be different from the number of straightening installations 5 inside a straightening station 3.

In the example of FIGS. 4 to 10, the detection system 6 comprises an obstacle detector of the laser range-finder type 60 that is movable along the transverse direction Y (in other words parallel to the row of candles 1) and placed in a raised manner relative to the receptacles 10 of the candles 1, in order to scan the entire candle for detecting the initial position of the wick 12.

Alternatively, the laser range-finder 60 is stationary and the candle 1 is movable along the transverse direction Y. In another variant, the detection system 6 comprises one or more infrared or visible camera(s), whose images will be the subject of a video processing to determine the initial position of the wick 12 relative to the receptacle 10.

In the illustrated example, the laser range-finder 60 is movable along the transverse direction Y over a distance provided to allow the laser range-finder 60 to scan the entirety of two neighboring candles 1 in the row (or even more, depending on the number of laser range-finders 60 provided in the straightening station 3).

During the operation of detecting the initial position of the wick 12, the laser range-finder 60 moves along the transverse direction Y by emitting a laser beam 61 directed along the longitudinal direction X. When the laser beam 61 cuts the wick 12 (which forms an obstacle for the laser beam 61), the transverse coordinate along the direction Y of the wick 12 is directly deduced, and the wick in turn returns the light ray and the laser range-finder 60 calculates the phase shift between the emission and the reception in order to deduce therefrom the longitudinal coordinate along the direction X of the wick 12. The initial position of the wick 12 thus corresponds to the combination of these transverse and longitudinal coordinates.

Figure 4:
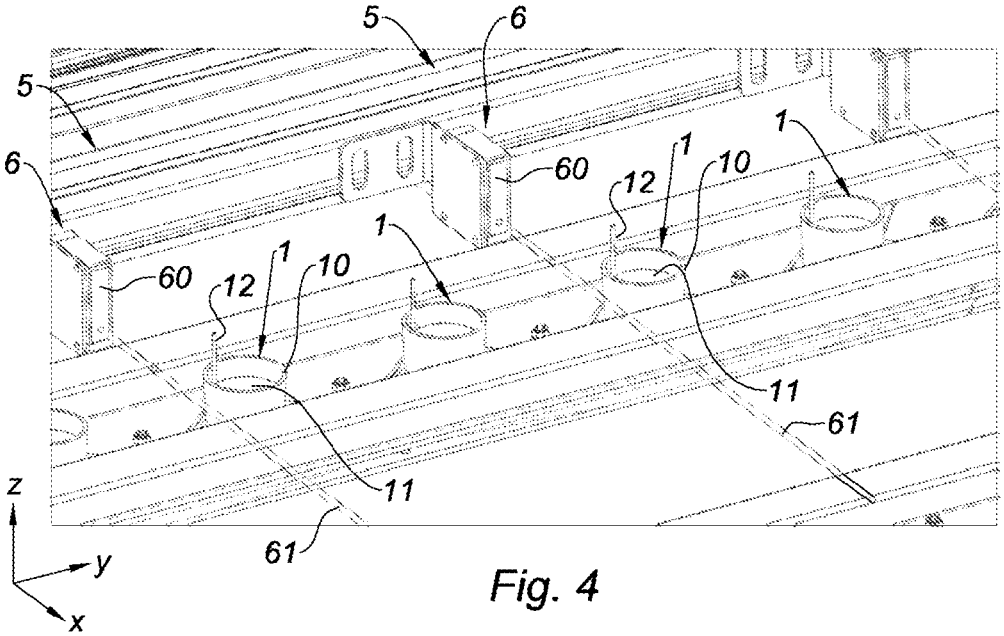
FIG. 4 is a an enlarged perspective view of a portion of the automated straightening station of FIG. 3 illustrating detection systems for automated straightening installations in which the detection systems are in an initial configuration at the beginning of the scanning in order to detect the initial positions of the candle wicks according to the present disclosure.
Figure 5:
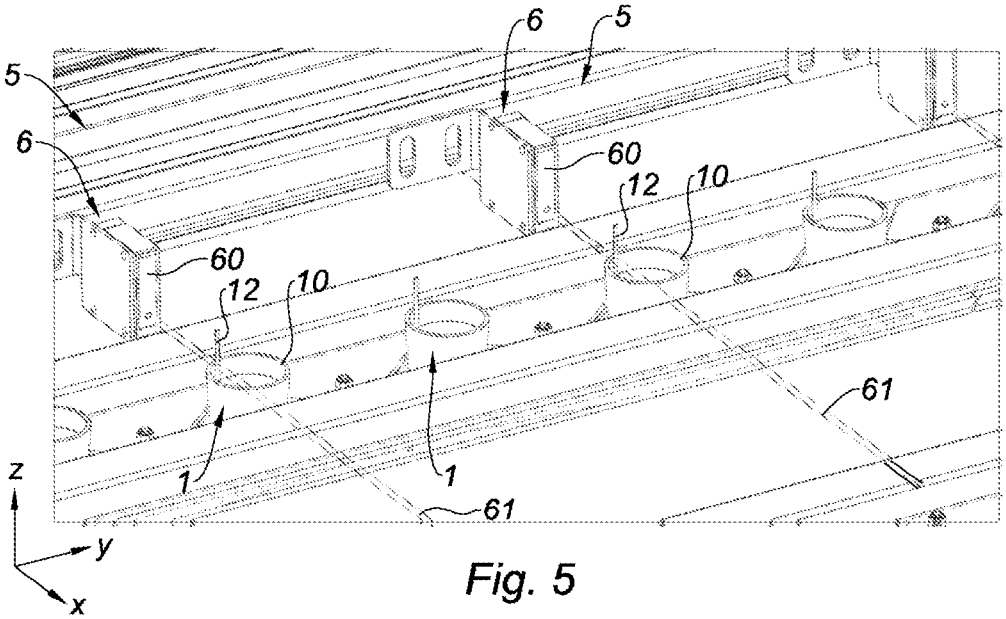
FIG. 5 is a view similar to that of FIG. 4, where the detection systems are in an intermediate configuration during the scanning according to the present disclosure.
Figure 6:
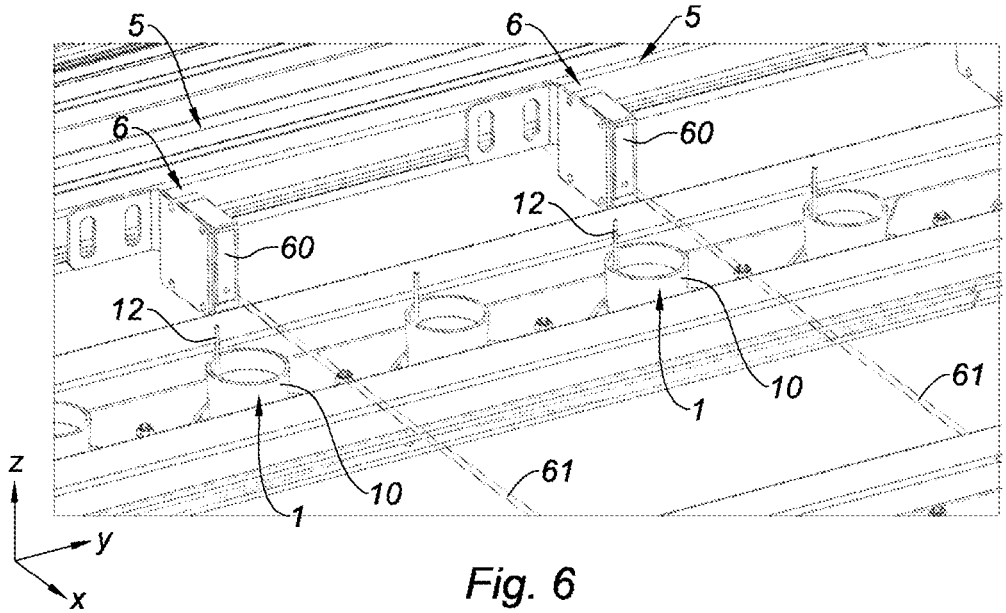
FIG. 6 is a view similar to that of FIG. 4, where the detection systems are in a final configuration at the end of the scanning according to the present disclosure.

With reference to FIGS. 4 to 6, the laser range-finder 60 starts the operation of detecting the initial position of the wick 12 of a candle 1, from a starting situation (as illustrated in FIG. 4) in which the laser beam 61 passes on one side (for example on the left) of the candle 1, then is displaced in translation along the transverse direction Y, until the laser beam 61 scans the candle 1 and cuts the wick 12 (as illustrated in FIG. 5), and ends the detection operation in an end situation (as illustrated in FIG. 6), in which the laser beam 61 passes on the other side (for example on the right) of the candle 1.

Referring to FIGS. 7 to 10, a straightening installation 5 further comprises a movable gripping system 7 able to grasp and displace the wick 12 relative to the receptacle 10, in order to straighten vertically at the center of the receptacle 10, from the initial position detected by the detection system 6 during the detection operation described above. For the sake of clarity, in FIGS. 7 to 10, only a gripping system 7 of a straightening installation 5 is illustrated, the gripping systems 7 of the neighboring straightening installations 5 not being drawn.

Between the detection operation and the straightening operation implemented by the gripping system 7, each candle 1 (or row of candles 1) remains stationary. In one variant, it is conceivable that each candle 1 (or row of candles 1) is displaced along the longitudinal direction X either by a given step in order to place the candle 1 (or row of candles 1) below the gripping system, or continuously without interruption of the displacement of the candles 1.

The gripping system 7 comprises a clamp 70 adapted to grasp the wick 12 and attached to a manipulator 71 movable along a vertical direction Z and along the transverse direction Y and/or along the longitudinal direction X.

Figure 7:
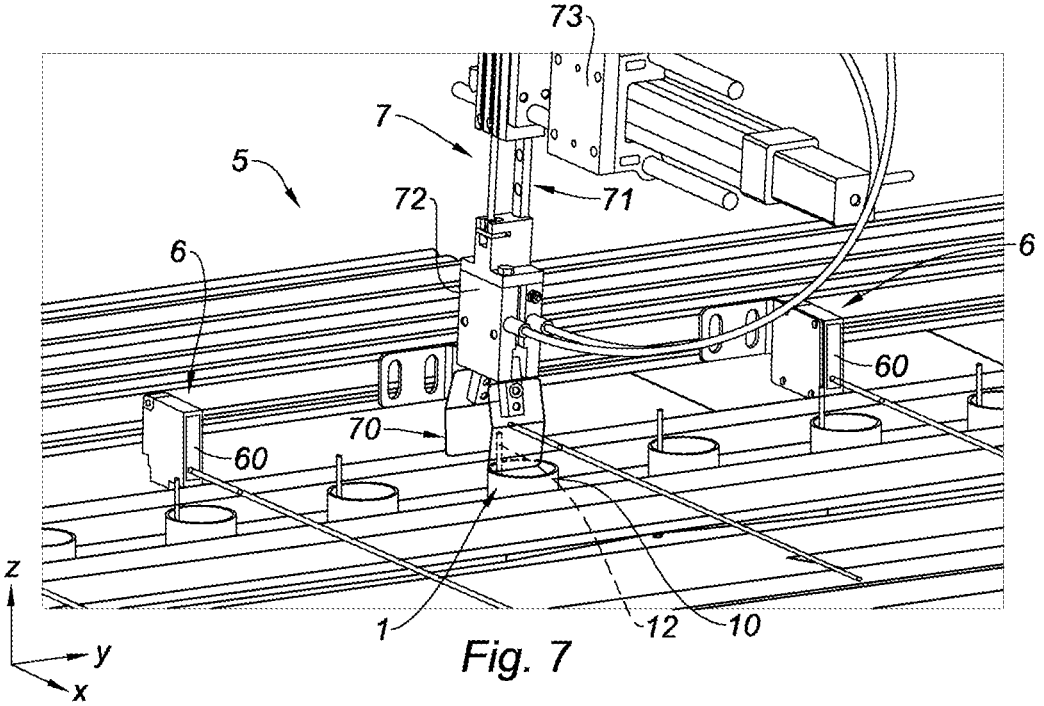
FIG. 7 is an enlarged perspective view of a portion of the automated straightening station of FIG. 3 illustrating detection systems and a gripping system, where the gripping system has left an initial raised configuration and occupies a lowered configuration with its clamp opened according to the present disclosure.
Figure 8:
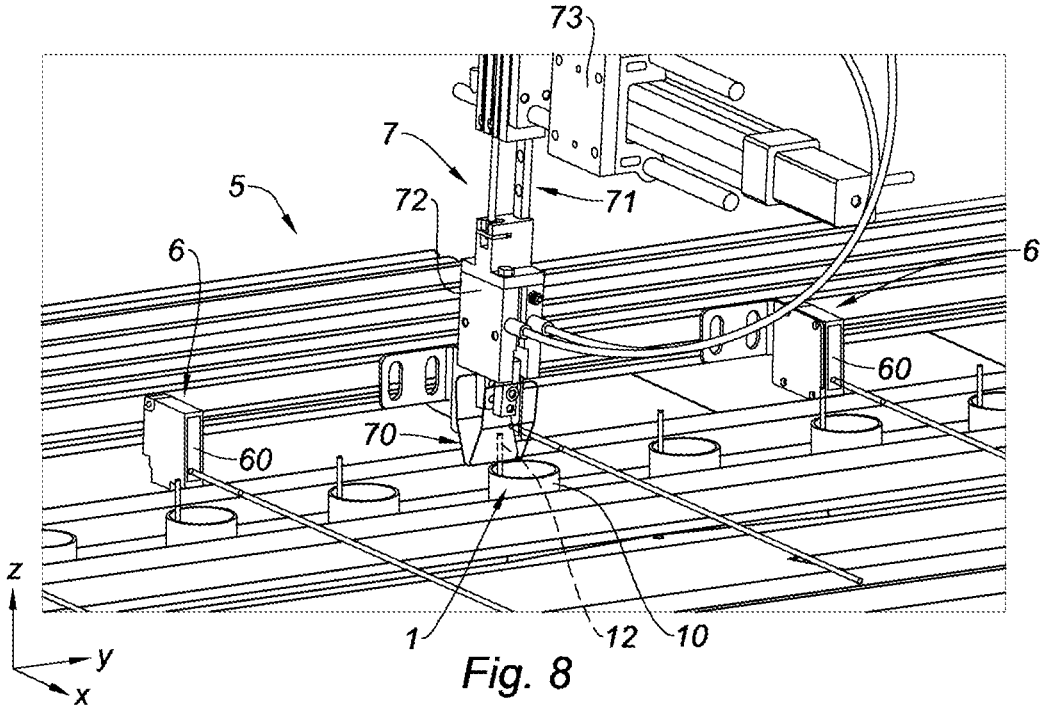
FIG. 8 is a view similar to that of FIG. 7, where the gripping system is, with its closed clamp, in an initial configuration for grasping a candle wick in its initial collapsed position according to the present disclosure.
Figure 9:
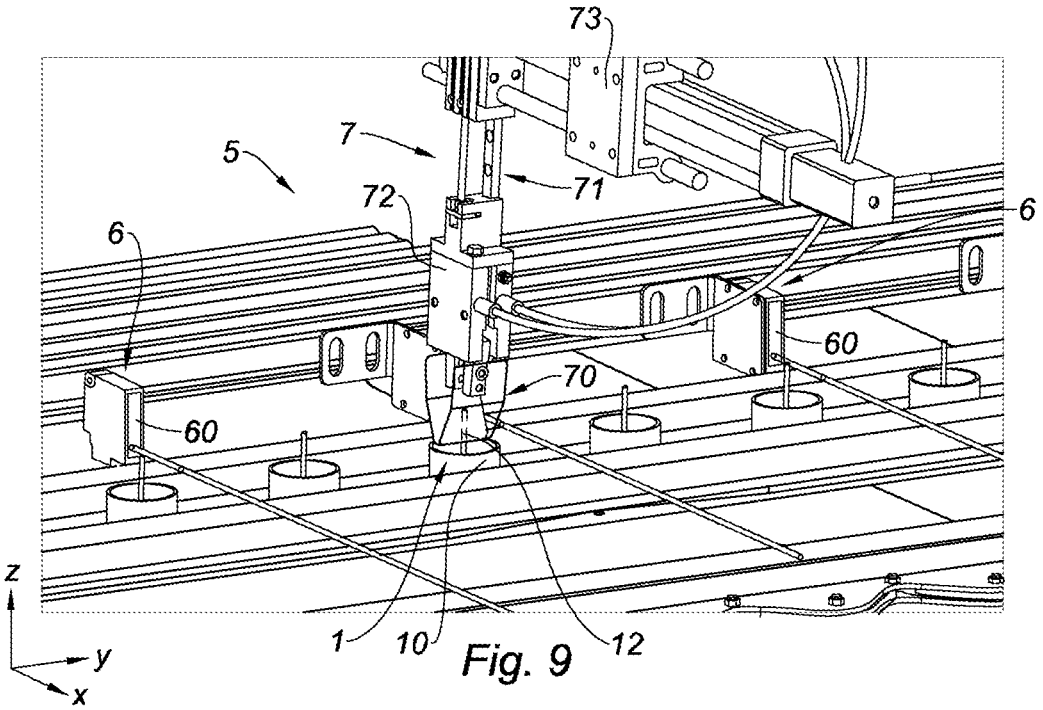
FIG. 9 is a view similar to that of FIG. 7, where the gripping system is, with its closed clamp, in a final vertical straightening configuration of the wick according to the present disclosure.
Figure 10:
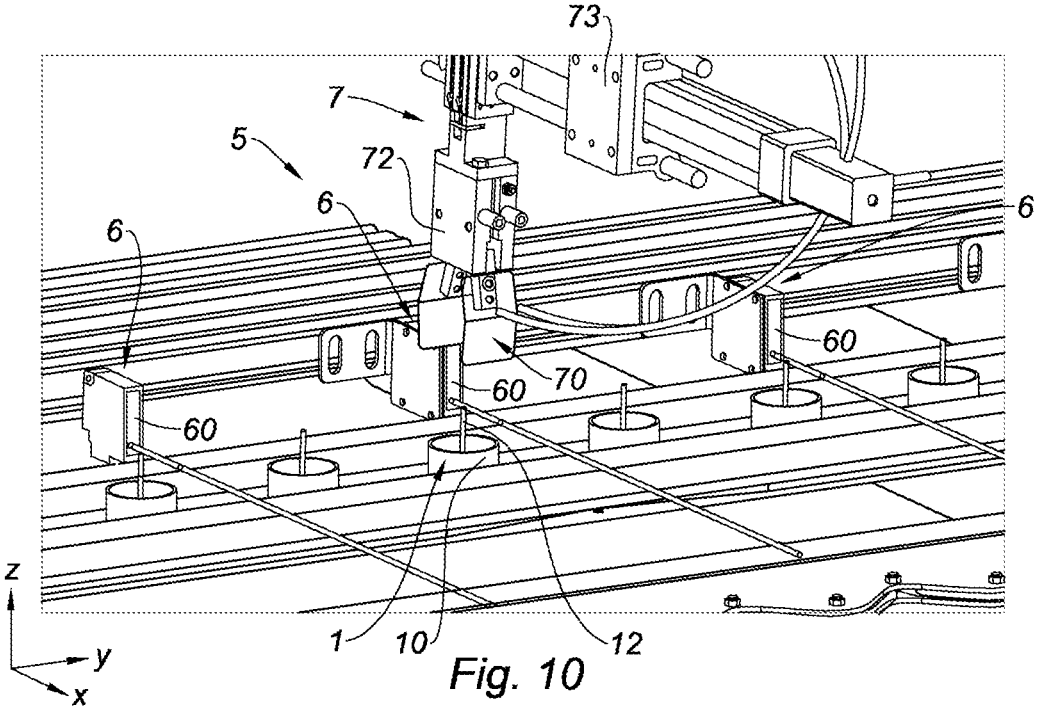
FIG. 10 is a view similar to that of FIG. 7, where the gripping system is, with its clamp open, returned to an initial raised configuration according to the present disclosure.

In the example shown, the clamp 70 is positioned directly above the receptacle 10 along a rest configuration (as illustrated in FIG. 7) and has a width equivalent to or even greater than the thickness of the wick 12, and the manipulator is movable along the vertical direction Z and also along both the longitudinal direction X and the transverse direction Y in order to be able to precisely make the clamp grasp the wick 2, then move the clamp at the center of the receptacle and finally raise the clamp along the vertical direction Z to vertically straighten the wick 12 at the center of the receptacle 10.

In a first variant not shown, the clamp is positioned directly above the receptacle 10 and has a width equivalent to or greater than the dimension of the receptacle along the longitudinal direction X (in other words its diameter if the receptacle is cylindrical), and when the clamp is closed, it defines a clamping line parallel to the longitudinal direction X and located in a median plane (or central plane) of the receptacle 10 along the longitudinal direction X. Thus, when the clamp is closed and has grasped the wick 12, it is then sufficient to displace the clamp 70 along the longitudinal direction X for replacing the wick 12 at the center, then to raise the clamp along the vertical direction Z for vertically straightening the wick 12 at the center of the receptacle 10. In this first variant, the manipulator is movable along the vertical direction Z and along the longitudinal direction X. However, if this clamp is to be used for another neighboring wick 1 in the row, the manipulator must also be movable along the transverse direction Y in order to be able to bring it over this other candle 1.

In a second variant not shown, the clamp is positioned directly above the receptacle 10 and has a width equivalent to or even greater than the dimension of the receptacle along the transverse direction Y (in other words, its diameter if the receptacle is cylindrical), and when the clamp is closed on the wick in the initial position, it defines a clamping line parallel to the transverse direction Y and is located in a median plane (or central plane) of the receptacle along this transverse direction. Thus, when the clamp is closed and has grasped the wick, it is then sufficient to move the clamp along the transverse direction Y for replacing the wick 12 at the center, then to raise the clamp along the vertical direction Z for vertically straightening the wick at the center of the receptacle before opening the clamp. In this second variant, the manipulator is movable along the vertical direction Z and along the transverse direction Y. This mobility along the transverse direction Y thus allows bringing the clamp 70 above another neighboring candle 1 in the row.

For the vertical displacement of the manipulator 71, and therefore of the clamp 70, the manipulator 71 may comprise a pneumatic cylinder 72 advantageously equipped with a pressure regulator allowing to regulate the force exerted vertically on the wick 12 when the clamp 70 is closed on the wick 12 and pulls it vertically.

For the transverse and/or longitudinal displacement of the manipulator 71, the manipulator 71 may comprise a single-axis or bi-axis, or tri-axis or multi-axis motorized electrical system 73.

In a non-illustrated variant, the manipulator 71 is a tri-axis or multi-axis robotic manipulator, so that the gripping system 7 forms a three-dimensional robotic clamp.

In order to drive the straightening installations 5, the straightening station 3 comprises a control system (not shown), in particular of the microcontroller, processor or computer terminal type, which is connected to each detection system 6 and to each gripping system 7, so that the control system provides the following sequences:

driving each detection system 6 (driving in a triggering manner of the laser beam 61 and driving in a displacing manner);

receiving the measurement of the initial position of the wick relative to the receptacle made by each detection system 6; and depending on each measurement, candle by candle, driving in a gripping manner (opening/closing of the clamp 70) and in a displacing manner (displacement of the manipulator 71), from a rest configuration to an initial configuration in which the clamp 70 grasps the wick in its initial position and then to a final configuration in which the clamp 70 has vertically straightened the wick at the center of the receptacle 10.

Of course, the example implementation mentioned above is not restrictive and other improvements and details can be brought to the straightening installation, to the straightening station and to the manufacturing line, without departing from the scope of the present disclosure where other types of gripping means can for example be made instead of a clamp and/or other types of contactless detection means can for example be made instead of a laser range-finder.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An apparatus for automatically straightening a plurality of candle wicks inside a plurality of receptacles containing a fusible combustible material in a solidification phase such that a candle wick is inside each of the plurality of receptacles, said apparatus comprising:

a straightening station comprising:

a detection system comprising a plurality of detectors, the detection system configured to detect an initial position of the candle wick inside each of the plurality of receptacles;

a movable gripping system configured to grasp and displace the wick inside and relative to each of the plurality of receptacles and, wherein the movable gripping system comprises at least one clamp attached to a manipulator movable along a vertical direction (Z) and along at least one horizontal direction (X, Y), the clamp adapted to grasp the wick; and a control system connected to said detection system and to said movable gripping system, the control system operable to drive said detection system to detect and receive said initial position of the candle wick inside and relative to each of the plurality of receptacles, and drive said movable gripping system from a rest configuration to an initial configuration in which said movable gripping system grasps the wick when in the initial position and then to a final configuration in which said movable gripping system vertically straightens the wick inside each receptacle; and a spacing unit configured to isolate rows of the plurality of receptacles at an inlet of the straightening station such that spaced apart rows of the plurality of receptacles are fed to the straightening station.

2. The apparatus according to claim 1 further comprising a system for holding the receptacle in a fixed position during detection by the detection system and during gripping and displacement of the movable gripping system.

3. The apparatus according to claim 1, wherein the movable gripping system is equipped with a device for regulating a force exerted vertically on the wick, the device for regulating a force comprising a pressure regulator.

4. The apparatus according to claim 1, wherein the plurality of detectors is selected from the group consisting of a laser range-finder, an ultrasonic range-finder, a radar range-finder, and at least one infrared or visible camera.

5. The apparatus according to claim 4, wherein the detection system comprises a range-finder movable relative to the receptacle and operable to scan an entire candle for detecting the initial position of the wick.

6. The apparatus according to claim 5, wherein the range-finder is horizontally movable relative to the receptacle of the candle.

7. A station for automatically straightening wicks of candles disposed in successive rows along a horizontal transverse direction (Y) and conveyed in translation along a horizontal longitudinal direction (X), said station comprising a plurality of automated apparatuses according to claim 1.

8. A candle manufacturing line comprising at least one station according to claim 7.

9. The candle manufacturing line according to claim 8 further comprising at least two stations separated by at least one conveyor for conveying the candles.

10. A method for automatically straightening a plurality of candle wicks inside a plurality of receptacles containing a fusible combustible material in a solidification phase such that a candle wick is inside each of the plurality of receptacles, said method comprising:

isolating rows of the plurality of receptacles into rows of receptacles using a spacing unit such that spaced apart rows of the plurality of receptacles are fed to an inlet of a straightening station;

detecting an initial position of the candle wick inside each receptacle of the spaced apart rows of the plurality of receptacles using a detection system configured to detect an initial position of the candle wick; and grasping the candle wick inside each receptacle of the spaced apart rows of the plurality of receptacles in the initial position and displacing said candle wick until said candle wick is vertically straight inside each receptacle using a movable gripping system configured to grasp and displace the candle wick inside each receptacle of the spaced apart rows of the plurality of receptacles, wherein the movable gripping system comprises a plurality of clamps attached to a manipulator movable along a vertical direction (Z) and along at least one horizontal direction (X, Y), the plurality of clamps adapted to grasp a plurality of wicks;

wherein a control system is connected to said detection system and to said movable gripping system, the control system operable to drive said detection system to detect and receive said initial position of the candle wick inside each receptacle of the spaced apart rows of the plurality of receptacles relative to each receptacle, and drive said movable gripping system from a rest configuration to an initial configuration in which said movable gripping system grasps the candle wick inside each receptacle of the spaced apart rows of the plurality of receptacles when in the initial position and then to a final configuration in which said movable gripping system vertically straightens the wick inside each receptacle.

* * * * *